US006286707B1

(12) United States Patent
Hall et al.

(10) Patent No.: US 6,286,707 B1
(45) Date of Patent: Sep. 11, 2001

(54) CONTAINER FOR ABOVE-GROUND STORAGE

(76) Inventors: William Y. Hall, 1360 Capitol Dr. #135, San Pedro, CA (US) 90732; William A. Hall, 2104 Paseo Del Mar, Palos Verdes Estates, CA (US) 90274

( * ) Notice: Subject to any disclaimer, the term of this patent is extended or adjusted under 35 U.S.C. 154(b) by 0 days.

(21) Appl. No.: 08/315,350

(22) Filed: Sep. 30, 1994

Related U.S. Application Data

(63) Continuation-in-part of application No. 08/028,213, filed on Mar. 9, 1993, now abandoned, which is a continuation of application No. 07/946,026, filed on Sep. 15, 1992, now Pat. No. 5,271,493, which is a continuation of application No. 07/759,703, filed on Sep. 11, 1991, now abandoned, which is a continuation of application No. 07/664,411, filed on Feb. 27, 1991, now abandoned, which is a continuation of application No. 07/452,690, filed on Dec. 19, 1989, now Pat. No. 5,096,050.

(51) Int. Cl.[7] ..... B65D 90/04
(52) U.S. Cl. ..... 220/567.2; 220/565; 220/592.2
(58) Field of Search ..... 220/401, 455, 220/469, 484, 565, 567.2, 592.2

(56) References Cited

U.S. PATENT DOCUMENTS

| | | | |
|---|---|---|---|
| 806,458 | 12/1905 | Brady . | |
| 1,024,527 | 4/1912 | Searle . | |
| 1,056,955 | 3/1913 | Stamm . | |
| 1,153,535 | 9/1915 | Babich . | |
| 1,180,367 | 4/1916 | Babich . | |
| 1,267,495 | 5/1918 | Babich . | |
| 1,355,122 | 10/1920 | Bintliff . | |
| 2,128,297 | 8/1938 | Ingersoll . | |
| 2,148,278 | 2/1939 | Rose . | |
| 2,189,945 | 2/1940 | Fitch . | |
| 2,643,022 | 6/1953 | Cornell . | |
| 2,754,992 | 7/1956 | Wilson . | |
| 2,777,295 * | 1/1957 | Bliss et al. | 220/565 X |
| 2,892,564 | 6/1959 | Morrison . | |
| 3,101,861 | 8/1963 | Mearns, III et al. . | |
| 3,118,559 | 1/1964 | Stricker, Jr. . | |
| 3,151,416 | 10/1964 | Eakin et al. . | |
| 3,338,010 | 8/1967 | Waugh . | |
| 3,473,689 | 10/1969 | Hutter . | |
| 3,666,132 | 5/1972 | Yamamoto et al. . | |
| 3,848,765 * | 11/1974 | Durkop | 220/469 X |
| 3,882,591 | 5/1975 | Yamamoto . | |
| 3,922,987 | 12/1975 | Tornay . | |
| 3,938,689 | 2/1976 | deMunnik . | |
| 3,942,331 | 3/1976 | Newman, Jr. et al. . | |

(List continued on next page.)

FOREIGN PATENT DOCUMENTS

| | | |
|---|---|---|
| 62-1320986 | 6/1987 | (JP) . |

* cited by examiner

*Primary Examiner*—Steven Pollard
(74) *Attorney, Agent, or Firm*—Gregory L. Roth

(57) ABSTRACT

A container for the above-ground storage of flammable fuels has an inner tank which may be rectangular, with a bottom surface, side surfaces, and a top surface, or which may be some other shape, such as cylindrical, placed within an outer shell having a similar shape. In the case of a rectangular inner tank and a rectangular outer shell, the bottom surfaces of the inner tank and outer shell are spaced apart from each other by first bottom spacers which connect the two bottom surfaces. The side walls of the inner tank and outer shell are also spaced apart from each other by second side spacers which connect the tank and shell. The side spacers for connecting the tank and shell prevent the inner tank from floating within the outer shell when an insulating material, such as concrete, is added therebetween. The inner tank may be constructed of metal, fiberglass, fiberglass-coated metal, polyethylene, or other like materials, while the outer shell is steel.

35 Claims, 6 Drawing Sheets

U.S. PATENT DOCUMENTS

| | | | | |
|---|---|---|---|---|
| 4,098,426 | | 7/1978 | Gerhard . | |
| 4,100,860 | | 7/1978 | Gablin et al. . | |
| 4,342,713 | | 8/1982 | Larkfeldt . | |
| 4,374,478 | | 2/1983 | Secord et al. . | |
| 4,638,920 | | 1/1987 | Goodhues, Jr. . | |
| 4,651,893 | * | 3/1987 | Mooney | 220/469 |
| 4,826,644 | * | 5/1989 | Lindquist et al. | 264/71 |
| 4,844,287 | | 7/1989 | Long . | |
| 4,871,081 | | 10/1989 | Ershig . | |
| 4,890,983 | | 1/1990 | Solomon et al. . | |
| 4,895,272 | * | 1/1990 | De Bendittis et al. | 220/565 X |
| 4,912,966 | * | 4/1990 | Sharp | 220/469 X |
| 4,915,545 | | 4/1990 | Ferrari . | |
| 4,948,340 | | 8/1990 | Solomon et al. . | |
| 4,960,151 | | 10/1990 | Kaminski et al. . | |
| 4,974,739 | * | 12/1990 | Gelin | 220/469 X |
| 4,986,436 | | 1/1991 | Bambacigno et al. . | |
| 4,989,750 | | 2/1991 | McGarvey . | |
| 4,991,613 | * | 2/1991 | Kaminski et al. | 220/565 X |
| 5,004,632 | * | 4/1991 | McGarvey et al. | 220/455 X |
| 5,012,949 | * | 5/1991 | McGarvey et al. | 220/455 |
| 5,016,689 | | 5/1991 | McGarvey et al. . | |
| 5,038,456 | | 8/1991 | McGarvey . | |
| 5,071,166 | | 12/1991 | Marino . | |
| 5,081,761 | | 1/1992 | Rinehart et al. . | |
| 5,082,138 | | 1/1992 | McGarvey . | |
| 5,103,996 | * | 4/1992 | McGarvey | 220/455 |
| 5,231,811 | | 8/1993 | Andrepont et al. . | |
| 5,251,473 | | 10/1993 | Reese . | |
| 5,271,493 | * | 12/1993 | Hall | 220/565 X |
| 5,282,546 | | 2/1994 | Bauer . | |
| 5,564,588 | * | 10/1996 | Reese | 220/565 |

FIG. 5
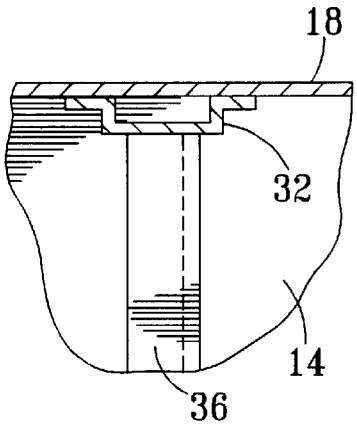
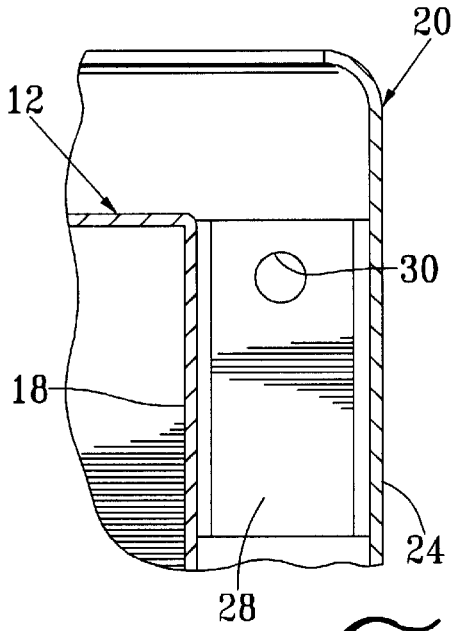
FIG. 6
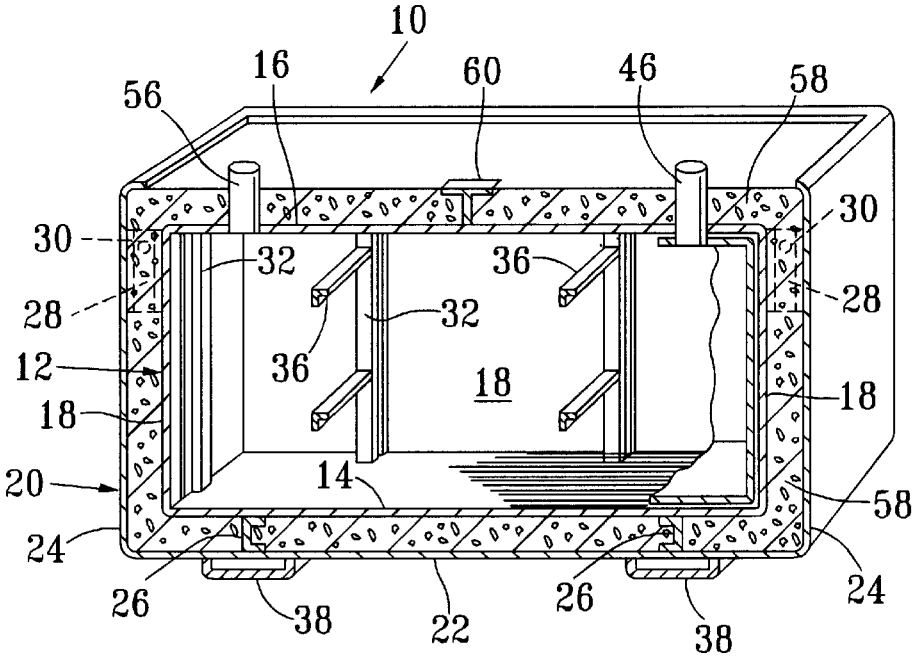
FIG. 7

CONTAINER FOR ABOVE-GROUND STORAGE

This application is a continuation-in-part of application Ser. No. 08/028,213, filed Mar. 9, 1993, now abandoned; which is a continuation of application Ser. No. 07/946,026, filed Sep. 15, 1992, now U.S. Pat. No. 5,271,493; which is a continuation of Ser. No. 07/759,703, filed Sep. 11, 1991, now abandoned; which is a continuation of Ser. No. 07/664, 411, filed Feb. 27, 1991, now abandoned; which is a continuation of Ser. No. 07/452,690, filed Dec. 19, 1989, now U.S. Pat. No. 5,096,050.

BACKGROUND OF THE INVENTION

1. Field of the Invention

The present invention relates to a container vault and, more particularly, to an above-ground storage tank for flammable liquids.

2. Discussion of Background

Since the 1970s, people in the United States as well as in other parts of the world, have become increasingly concerned with the environment and the contamination of that environment, including the earth's soil, its atmosphere, and its water. The first Earth Day in 1970 resulted in the eventual creation of the Environmental Protection Agency by the United States Congress.

One of the many problems which the Environmental Protection Agency has addressed in recent years is the deterioration of large, underground storage tanks which has resulted in the leakage of contaminants into the soil. For example, the deterioration of gas station storage tanks has resulted in the leakage of gasoline and diesel fuel into the surrounding water table.

To correct this problem, the EPA has suggested that all fuel storage tanks be placed above ground. However, this has created a classic confrontation between governmental departments, since the fire departments of most major cities prefer that fuel storage tanks be placed below ground to reduce fire hazard. Most municipal codes have been drafted with this concern in mind. In more recent years, the creation of large concrete-entombed tanks has been suggested as a solution to the problem. In accordance with this suggestion, a gasoline storage tank may be entombed in concrete and placed above the ground to enable its surfaces to be easily checked for deterioration and fluid leakage. By entombing the fuel tank in concrete, the tank was thought to be impervious to impact from a vehicle that might back into it, for example, and resistant to fire due to the insulating effect of the concrete. One example of such an entombed tank is shown in U.S. Pat. No. 4,826,644, issued May 2, 1989 to T. R. Lindquist and R. Bambacigno.

The concrete entombed tank has several disadvantages, however, including cost and convenience. For example, a 1,000-gallon concrete-entombed tank weighs 18,000 pounds after it has been manufactured, and such a tank requires a large truck and crane with at least two 20-ton nylon straps to transport it to the site where it is to be used and to then place the tank in the desired position. The concrete-entombed tank is provided with bottom supporting feet to permit the inspection of its bottom surface during its use. In California, where earthquakes represent a real concern, concrete shoes are placed on the site on either side of the bottom supporting feet to prevent the movement of the tank during an earthquake. The placement of the concrete tank between the concrete shoes can be a very dangerous procedure in view of the tank's weight.

Another disadvantage of the concrete-encased tank is that the exposed concrete is subjected to environmental effects, such as varying temperatures, which eventually lead to cracking and deterioration. Because of these problems, exposed concrete typically must incorporate heavy aggregate such as stone, increasing is weight and at the same time reducing its insulating qualities.

SUMMARY OF THE INVENTION

Accordingly, it is an object of the present invention to provide a less expensive, lighter weight and more easily transported container for the above-ground storage of liquid fuels, such as gasoline and diesel fuel.

It is another object of the invention to provide a protective vault for above-ground storage tanks, wherein the vault consists of an insulating material such as lightweight concrete encased in a steel protective shell to prevent deterioration of the insulating material while providing increased safety.

These and other objects are accomplished in accordance with one embodiment of the invention, by providing an inner tank having a bottom surface, side surfaces, and a top surface which is placed within an outer shell having a bottom surface, side surfaces, and an open top. The bottom surface of the inner tank is spaced apart from and connected to the bottom surface of the outer shell by first bottom spacers which do not extend to the side surfaces of either the inner tank or outer shell. The side surfaces of the inner tank and the outer shell are spaced apart and attached to one another by second side spacers which do not extend to the bottom surface of either the inner tank or outer shell. The spacers function to prevent the inner tank from floating within the outer shell when an insulating material, such as concrete, or more particularly a lightweight concrete, is placed in the space therebetween.

In other embodiments of the invention, the inner tank, the outer shell, or both may be cylindrical, with appropriate spacers or straps positioning and securing the inner tank within, and spaced from, the walls of the outer shell. The inner tank may be single or double walled, and may be made from any of a variety of materials, such as steel or other suitable metals, fiberglass, fiberglass-coated metal, polyethylene, or the like. The insulating material, which is located between the inner tank and the outer shell, cooperates with the steel outer shell to provide a protective vault for the inner storage tank, with the steel shell protecting the concrete, maintaining its integrity, and preventing deterioration due to weather, abuse, and ageing. The outer shell is supported on feet, and incorporates suitable inlets through which the insulating material is introduced into the space between the walls of the inner tank and the outer shell.

The construction of the protective vault which allows the use of a lightweight insulating material, permits the container to be constructed and filled with the insulating material at the factory, and transported to a location of use after completion. Alternatively, the utilization of an inner tank and outer shell, with appropriate spacers for locating one within the other, permits an assembled tank to be shipped from the factory to the site where it is intended for use before the concrete is added, so that the tank is moved with relative ease because of its even lighter weight. In the latter case, once the container is properly placed upon the site, the space between the inner tank and outer shell can be filled with a suitable insulation material to meet the strength and insulation requirements of the fire codes of all metropolitan areas. Spacing feet on the bottom surface of the outer shell permit all surfaces of the tank vault to be inspected to assure that the tank does not deteriorate and leak. As noted above, the outer shell is steel to allow the use of lightweight concrete while protecting the concrete from damage so it will retain its insulating value, thus providing a protective vault for the inner tank and thereby meeting the requirements of the Environmental Protection Agency.

In accordance with the present invention, the use of the lightweight insulating material disposed between a metal outer tank and an inner tank is particularly advantageous in that the lightweight insulating materials have superior insulating characteristics as compared with, for example, standard concrete. Although not to be construed as limiting upon the present invention, an example of a lightweight insulating material can be lightweight concrete having entrapped air therein. The entrapped air provides both greater insulating performance as well as a lighter weight construction, such that the insulating material need not be added at the installation site, since transport of the completed container is less burdensome than arrangements which utilize standard concrete. In accordance with a further advantageous aspect of the present invention, the feet which support the container can be formed of a metal such as steel, with an insulating material such as concrete or lightweight concrete disposed therein. The concrete or lightweight concrete within the feet maintains stability of the tank even when subjected to temperatures sufficient to weaken the steel outer casing of the feet. Such stability is particularly important where cylindrical tank configurations are utilized. Further, as with the construction of the container itself, the use of a metal casing filled with concrete reduces the effect of cracking or environmental deterioration upon the concrete.

In accordance with a further advantageous aspect of the present invention, a nonmetallic construction can be provided for the inner tank. In the past, fiberglass constructions have been unacceptable for above-ground tanks due to their relatively low strength as compared with metal tanks. However, by providing a fiberglass or other nonmetallic construction in combination with an outer metallic shell, with the insulating material between the outer shell and inner tank, sufficient integrity of the overall construction is provided with respect to, for example, impact and ballistic test requirements. Further, the use of a nonmetallic inner tank construction is particularly advantageous in that materials can be utilized which are less subject to deterioration or corrosion resulting from the materials contained within the tank, condensation within the inner tank, and the insulating material (e.g., concrete) which contacts the outer surfaces of the inner tank when it is poured into the space between the outer tank and the inner tank.

BRIEF DESCRIPTION OF THE DRAWINGS

A better understanding of the present invention and of additional advantages and objects thereof will become apparent after consideration of the following detailed description, particularly when considered in conjunction with the accompanying drawings, wherein:

FIG. 5 is a detailed view showing the inner support ribs of the inner tank;

FIG. 6 is a detailed view of the side spacers between the inner tank and outer shell;

FIG. 7 is a cross-sectional view, taken along line 7—7 of FIG. 2, shown in perspective after insulating material, such as concrete, has been poured between the inner tank and outer shell of the tank vault;

DESCRIPTION OF THE PREFERRED EMBODIMENTS

Figure 1:
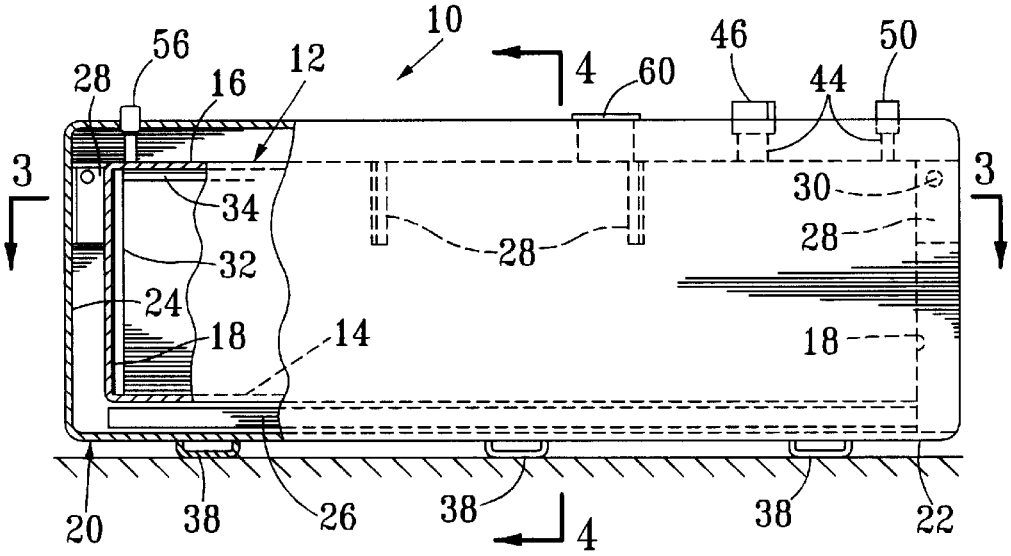
FIG. 1 is a side elevational view of one embodiment of the container of the present invention.

Referring now to the drawings, a vaulted container 10 is shown in FIGS. 1–7 as having an inner tank 12 including a bottom surface 14, top surface 16 and side surfaces 18. The inner tank may be constructed from various types of material including steel, corrosion-resistant steel, aluminum cast iron, fiberglass, fiberglass-reinforced steel, and polyethylene. In the preferred embodiment, the inner tank is constructed from 3/16-inch thick steel.

The inner tank 12 is spaced apart from an outer shell 20 which also has a bottom surface 22 and side surfaces 24, while the top of the outer shell 20 is open. In the preferred embodiment, the outer shell is made of 10 gauge steel. The inner tank 12 and outer shell 20 may be attached in a spaced-apart relationship by, for example, a first, bottom spacer 26 which may be constructed from a C-shaped steel channel that is six inches long and weighs 8.2 pounds per foot (C×6×8.2). This same C-shaped channel may also be used as a second side spacer 28 which attaches and spaces the side surfaces 18 and 24 of the inner tank and outer shell.

The first, bottom spacer 26 may be attached to the bottom surface 14 of inner tank 12 by welding. Similarly, the second side spacers 28 maybe attached to the side surfaces or walls 18 of inner tank 12 by welding. The inner tank 12 may then be lowered into the outer shell 20 and the first, bottom spacers 26 attached to the bottom surface 22 of the outer shell 20 with welding plugs which are formed by welding through small holes in the bottom surface 22 directly to the lower surface of the bottom spacers 26 to fill the holes and thus produce the welding plug for the attachment of the spacers 26. Generally, it is not necessary to use welding plugs to attach the second, side spacers 28 to the side surfaces 24 of the outer shell 20, as seen in FIG. 6. FIG.6 shows an aperture 30 in the side spacer 28 which may be used to secure a hook for lifting the assembled tank vault 10 from a truck and placing it at the desired location upon the site where the tank vault 10 is to be used. It will also be seen in FIG. 6 that the upper edges of the side walls 24 of outer shell 20 are each provided with a radius which establishes a smooth rounded upper edge of the tank vault 10 once the insulating material, such as concrete, is poured between the inner tank 12 and outer shell 20. As illustrated in FIGS. 1, 6, and 7, the side spacers 28 do not extend to the bottom surfaces 14 or 22 of the inner tank 12 or outer shell 20. Similarly, the bottom surface 26 does not extend to the side walls 24 of outer shell 20. This permits the insulation material to flow completely between the inner tank 12 and outer shell 20.

The inner tank 12 may be in the shape of a rectangular block with the outer shell 20 also shaped as a rectangular block. Other configurations are possible within the teaching of the present invention, including a cubically-shaped inner tank and outer shell, a cylindrically-shaped inner tank mounted within a cylindrical outer shell, or a cylindrically-shaped inner tank mounted within an outer shell in the form of a rectangular block. In the cases of a cylindrical inner tank, the bottom surface of the inner tank is the bottom edge of the cylindrical shape while the side walls include the two side edges of the cylinder and the two flat ends thereof.

It has been fond that supports for positioning the inner tank within the outer shell, such as the second, side supports 28, are very important in the fabrication of a vault having an inner tank 12 and a spaced outer shell 20, in that the pouring of the insulating material, such as concrete, can cause the inner tank 12 to float within the outer shell 20 and to be displaced, causing the insulating layer to become nonuniform. This problem has not occurred in the prior art as the prior art generally does not contemplate such a large volume when fabricating inner and outer tank structures. Further, the prior art does not contemplate the problems that would be experienced when an insulating material, such as concrete, is poured to fill the space between the inner tank 12 and the outer shell 20. Such problems include the possible bowing of either the inner side walls 14 or the outer side walls 20 of tank 12 and shell 20 and the collapse of the top surface 16 of tank 12. To eliminate this problem, inner supports are utilized, including inner side supports 32, shown in FIGS. 1, 3, 4, 5, and 7, and inner top supports 34, shown in FIGS. 1, 2, and 4. The inner side supports 32 may be made of 10 gauge steel sheets with a hat-shaped cross-section having a three inch crown, one inch sidewalls and a one inch brim on the outer edge of each side wall, and the inner top supports 34 may be formed from the same material and in the same shape.

Further support is provided to the side surfaces 18 of inner tank 12 by cross-rib supports 36 illustrated in FIGS. 3, 4, 5, and 7. It will be seen in FIGS. 3 and 4 that the illustrated embodiment may include three pairs of cross-rib supports which attach opposite side walls 18 of the inner tank 12 at the inner side supports 32. As seen in FIG. 7, the cross-rib supports 36 may be formed from a 2×2×¼-inch angle channel which is attached to the inner supports 32, as by welding. Similarly, the inner side supports 32 and top supports 34 may be attached to the side surfaces 18 and top surface 16 of the inner tank 12 by welding.

Figure 2:
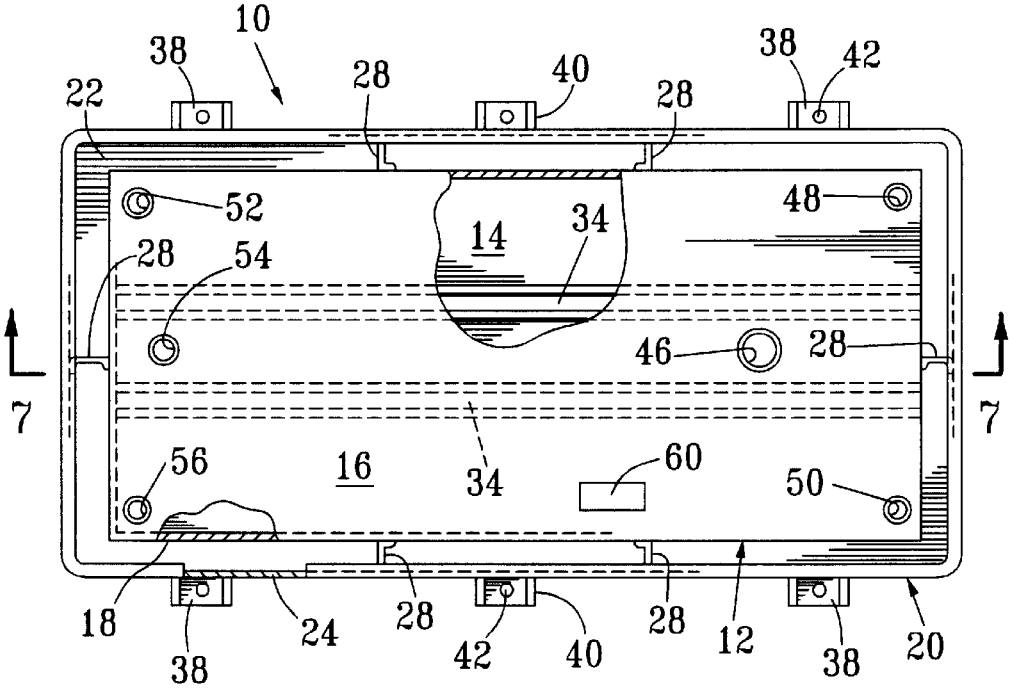
FIG. 2 is a top plan view thereof.
Figure 3:
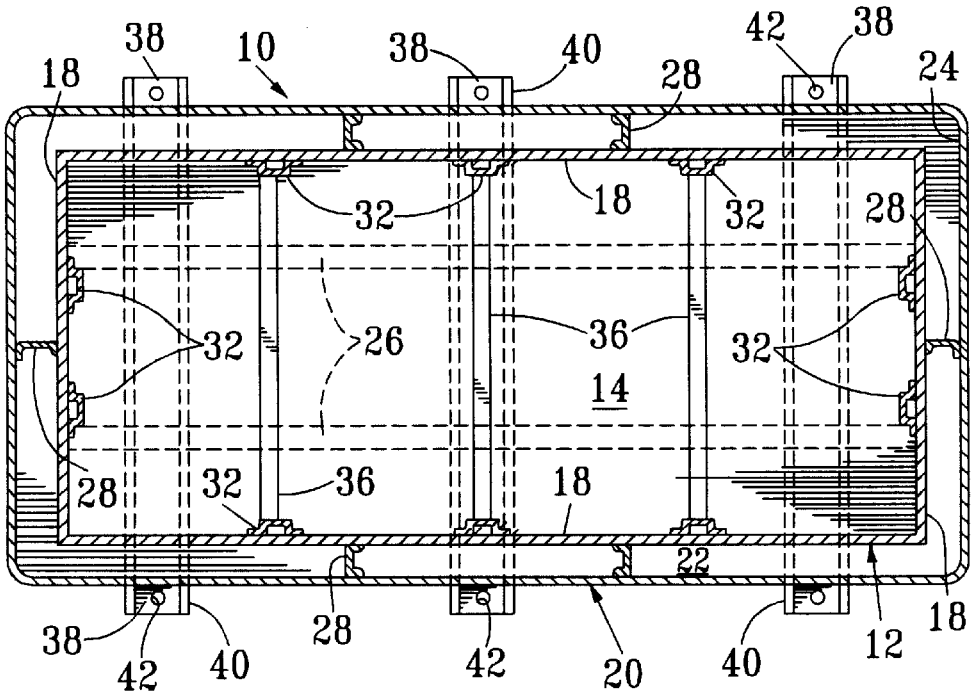
FIG. 3 is a cross-sectional view taken along line 3—3 of FIG. 1.
Figure 4:
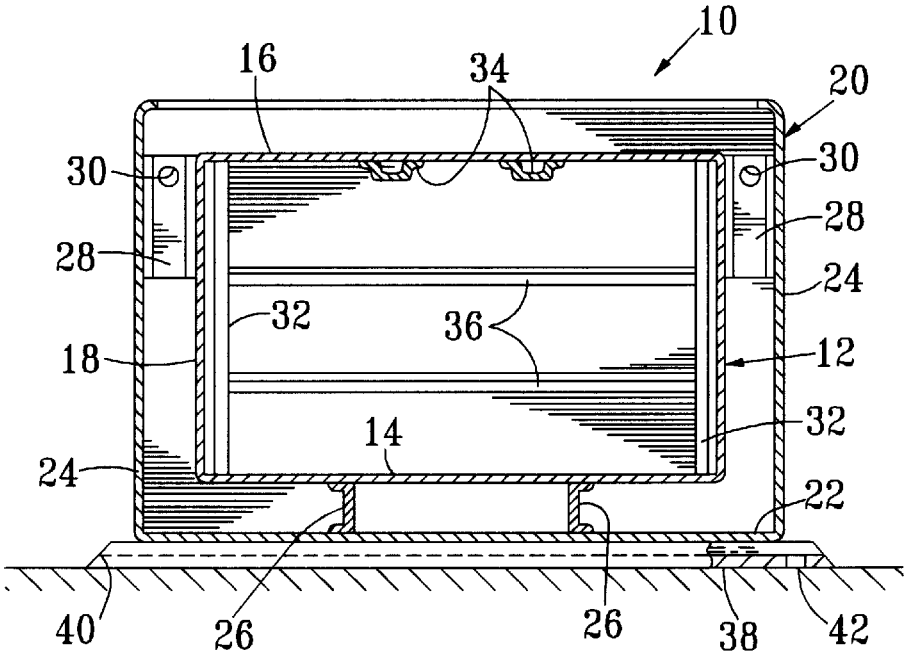
FIG. 4 is a cross-sectional view taken along line 4—4 of FIG. 1.

To complete the prefabricated assembly of the container 10, a third set of spacers or mounting feet 38, illustrated in FIGS. 1, 2, 3, 4, and 7, are attached to the bottom surface 22 of outer shell 20, as by welding. These mounting feet 38 may be formed from the same C-shaped channel that forms the bottom and side spacers 26 and 28. As best seen in FIGS. 2, 3, and 4, the mounting feet 38 extend beyond the width of the outer shell 20 to form extensions 40 into which apertures 42 have been placed, as seen in FIG. 3. These apertures receive suitable lag bolts or other fasteners which may be driven into a concrete mounting pad or other suitable mounting surface upon which the tank vault 10 is ultimately placed. The extensions 40 thus provide a convenient way for securing the container 10 to the surface of its mounting site to prevent it from "walking" during an earthquake.

As best seen in FIGS. 1 and 2, the top surface 16 of inner tank 12 is provided with several apertures into which various sized pipe fittings 44 may be attached, as by welding. The purpose of these pipe fittings 44 are many and varied. In the preferred embodiment shown in FIG. 2, they include the following: a six-inch tank bung 46 located in the center of the right-hand portion of the top surface 16 for mounting a 2.5-pound emergency vent; a two-inch tank bung 48 located in the upper, right-hand corner of the top surface 16 for a vent; a two-inch tank bung 50 located in the lower, right-hand surface of tank cover 16 to mount a sight level gauge; a four-inch tank bung 52 in the upper, left-hand corner of top surface 16 for a phase one vapor recovery device; a four-inch tank bung 54 in the center, left-hand section of the top surface 16 for filling the tank 10; and a two-inch tank bung 56 in the lower, left-hand corner of surface 16 for a gas pump.

The container 10 illustrated in FIGS. 1–7 weighs approximately 2,400 pounds (i.e., without concrete) in the prefabricated state as shown in FIGS. 1–6 and holds 1,000 gallons. Several variations of the tank structure are possible, and the specific shape and sizes of the inner and outer tanks, the bottom spacers 26, side spacers 28, mounting feet 38, side supports 32, top supports 34, and cross-rib supports 36 may all vary within the teachings of the present invention. Further, the inner tanks 12 may be fabricated with double-sided top, sides and bottom walls as shown in FIG. 7. The size of the container 10 may also vary to accommodate many volumes, and this may be 250, 500, or 1,000 gallons, or as large as 12,000 gallons.

In the invention illustrated in FIGS. 1–7, it is anticipated that a 250 gallon tank container 10 will have an inner tank 12 with a length of 80 inches, a height of 25 inches, and a width of 30 inches. The dimensions of the outer shell 20 will include a length of 92 inches, a height of 37 inches, and a width of 42 inches. This 250 gallon tank will have a single side spacer 28 that is 12 inches long, and two sets of vertical inner side supports 32 with a single cross-rib support 36 between each. A 500 gallon container 10 has an inner tank dimension of 120 inches long by 26 inches high by 37 inches wide, and an outer shell dimension of 132 inches long by 38 inches high by 49 inches wide. Along the length of the side walls 18 and 24 of the inner tank 12 and outer shell 20 are two side spacers 28, while the inner side supports 32 number three along the long side wall with single cross-rib supports 36 therebetween. A 1,000 gallon container has an inner tank dimension of 120 inches long by 46 inches high by 42 inches wide with the outer shell dimensions being 132 inches by 58 inches by 54 inches. The inner supports are the same as for the 500-gallon tank except that there are two cross-rib supports 36 between each of the inner side supports 32 rather than one. A 2,000 gallon container includes an inner tank 12 with a length of 120 inches, a height of 55 inches, and a width of 70 inches; while the outer shell measures 132 inches long by 67 inches high by 82 inches wide. The side supports 28 are twice as long as the side supports within the 1,000 gallon tank, while the inner side supports 32 and cross-rib supports are the same in number as for the 1,000 gallon tank. Each tank has the same number of bottom spacers 26 for providing a standoff between the inner tank and outer shell. The 250 gallon tank has two mounting feet 38, while the larger tanks preferably have three.

After the container 10 has been properly supported, with the inner tank 12 mounted within and supported by the outer shell 20, the space between inner tank 12 and outer shell 20 may be filled with a suitable insulating material 58, shown in FIG. 7. The container may be located at a manufacturing facility for filling before being transported, or it can be transported empty to a location where it is to be used, and the filled with insulating material. In the preferred embodiment, this insulating material is concrete, preferably lightweight concrete. However, other materials may be used, including lightweight concrete incorporating various aggregates or fillers, cement, sand, gravel, heat-resistant plastics such a polyethylene, or a fire-retardant foam. In general, the insulating material should be fire-resistant and meet or exceed a two-hour firewall rating. The outer shell is filled to a level equal to the upper edge of its side walls 24 so that the rounded edges thereof are flush with the upper surface of the insulating material. A T-shaped standoff 60 may be attached to the top surface 16 of inner tank 12, as by welding. It will be seen that the standoff 60 is flush with the upper surface of the insulating material 58. This standoff 60 thus provides a mounting platform upon which to place a nameplate or other information. Once filled with concrete 58 or other insulating material, a gasoline pump, not shown, may be mounted to the side surface 24 of the outer shell 20 and connected to the two-inch tank bung 56.

As discussed above, many shapes of the inner tank 12 and outer shell 20 are possible. The inner tank 12 may be constructed from several different materials and the space between it and the outer shell 20 may be varied and filled with several different insulating materials within the teachings of the present invention. Further, the shape, number, configuration, and material of the bottom spacers 26, side spacers 28, inner side supports 32, inner top supports 34, cross-rib supports 36, and mounting feet 38 may vary within the teachings of the present invention. It will also be noted that the placement of the inner side supports 32 within the inner tank 12 is usually such that they do not align themselves with the side supports 28, thereby increasing the rigidity of the side walls 18. One such variant of the foregoing embodiment is illustrated in FIGS. 8 and 9, to which reference is now made.

Figure 8:
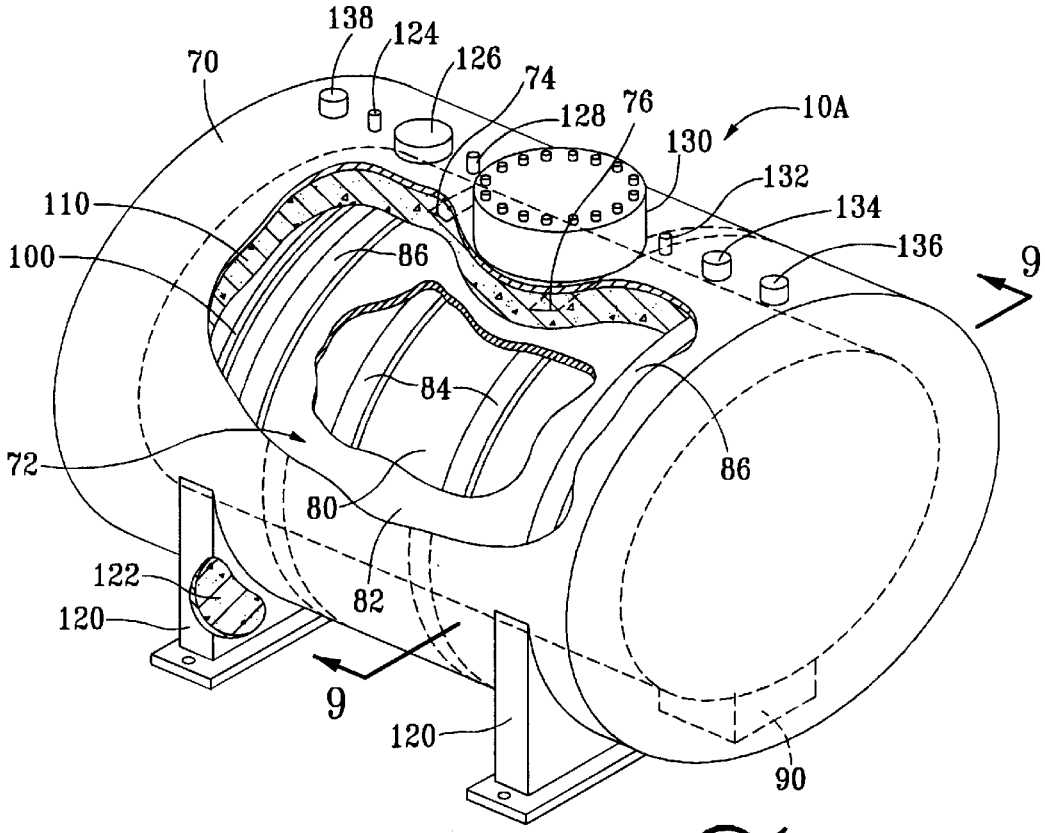
FIG. 8 is a perspective view, in partial section, of a second embodiment of the invention, illustrating a double-walled fiberglass inner tank and a steel outer shell.
Figure 9:
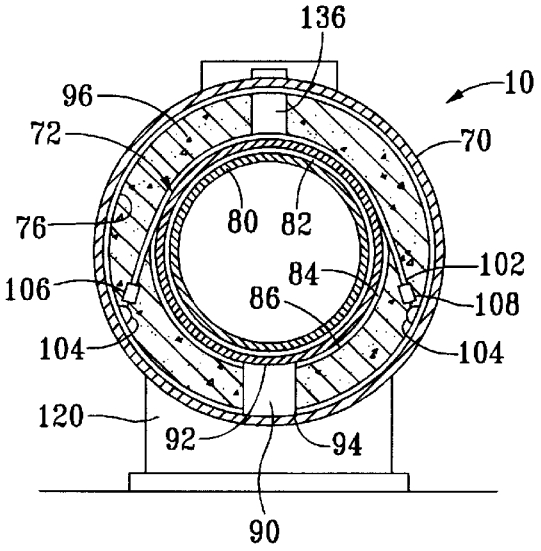
FIG. 9 is a cross-section of the container of FIG. 8, taken along line 9—9.

FIGS. 8 and 9 illustrate a container 10A which enables fiberglass tanks to be used for above-ground storage of flammable liquids. Fiberglass has not previously been usable in above-ground storage of such liquids, since fiberglass could not meet the requirements of the Underwriters Laboratories standards. However, by placing fiberglass inner tanks within an outer steel tank and providing a fire resistant insulation between the two, in the manner discussed above, fiberglass can be used in above-ground storage situations. Accordingly, the container 10A includes an outer steel cylindrical shell 70 in which is located an inner tank 72 formed of fiberglass-reinforced plastic resin which preferably is also cylindrical in shape. The inner tank may be a single wall or a double wall tank, with a double wall tank being illustrated in FIGS. 8 and 9. The steel shell 70 preferably is constructed of A-36 hot rolled steel with a minimum thickness of 3/16" and having suitable circumferential reinforcing ribs 74 and 76, as required. The number of reinforcing ribs will depend upon the size of the shell.

In a double-wall tank embodiment, the inner tank 72 incorporates a first, innermost fiberglass tank wall 80 and a concentric, outwardly spaced second fiberglass wall 82. The two walls may be separated by fiberglass reinforcing ribs such as the ribs 84 in one form of the invention, and additional reinforcing ribs 86 may be provided around the circumference of the outer wall 82 of tank 72 to provide the required strength for the inner tank. Other double-walled tank arrangements can be provided. Preferably, the space between the double walls of the inner tank are vented, for example by an additional bung, to avoid excessive pressures therein, particularly when subjected to heat or fire. In addition, leak detection devices can also be provided between the double walls of the inner tank, with access thereto provided by an additional bung. Such devices can include, for example, liquid or vapor sensors.

Tank 72 is positioned within shell 70 so as to be concentric therewith, with one or more supports 90, such as cement blocks, being provided between the bottom of the inner tank 72 and the bottom of the outer shell 70 to produce the required spacing. The top and bottom surfaces 92 and 94 of the blocks 90 may be slightly curved to accommodate the shape of the inner tank and the outer shell so as to position the inner tank concentrically within the outer shell and to hold it in that position as insulating material is poured into the space 96 between the inner tank 72 and the outer shell 70. Preferably, the blocks are formed of an insulating material, for example, the same lightweight concrete used to fill the space between the inner tank and outer shell.

In the preferred form of the invention, fiberglass tie-down straps 100 and 102 are provided to secure the inner tank within the outer shell and to prevent flotation as insulation is poured into space 96. The straps are secured to suitable eyelets 104 mounted on the interior surface of shell 70 or secured to circumferential reinforcing ribs 74 and 76, by means of turnbuckles 106 and 108.

When the space 96 is filled, the inner fiberglass tank 72 is uniformly encased in a layer 110 which is preferably about six inches thick, as determined by the distance between the outer surface of the inner tank 72 and the inner surface of shell 70. The insulating material preferably is a lightweight concrete capable of preventing excessive internal tank temperatures during a 2000° F. fire test, in accordance with Underwriters Laboratories requirements. In order to best meet this requirement, the insulation should not contain any aggregates that would act as heat sinks or would produce "hot spots", and should be a monolithic "seamless" pour so that the insulation is of a one piece construction with no cold joints or sections; however, the concrete may include some aggregate to provide light weight, as long as the temperature requirements are met.

In accordance with one aspect of the present invention, it has been recognized that the use of a lightweight insulating material, such as lightweight concrete, is particularly advantageous in providing superior insulating properties as compared with standard concrete, yet when utilized in combination with an outer metallic shell, sufficient integrity of the overall structure is maintained. By way of example, and not to be construed as limiting upon the present invention, the insulating material can be a lightweight concrete having entrapped air therein. Such a concrete material can be provided using a foam injection system/process in which foam or air is injected into a concrete and water mixture such that the resulting concrete has a significant quantity of entrapped air. Of course, other lightweight insulating materials are possible within the present invention, including concrete having additives which decrease the weight and increase the insulating properties of the concrete. The entrapped air or other additives in a concrete construction thus increase the insulating properties of the insulating material, while nevertheless providing an insulating material in a pourable form.

In the past, fire test requirements have mandated that when a tank is exposed to a 2000° F. fire test for two hours, the temperature within the inner tank cannot exceed 400° F. However, such requirements have recently been reduced to 260° F., which is difficult to achieve, particularly with a standard concrete construction, for example, concrete which includes rocks or gravel. However, in accordance with the present invention, with a metal outer tank, a fiberglass inner tank, and a lightweight air-entrapped concrete disposed between the outer shell and inner tank, the temperature inside the inner tank rose to only 140° F. when subjected to a 2000° F. fire test for two hours. For this test, a 250 gallon capacity tank was utilized.

A further advantageous result of the present invention resides in the significantly lighter weight of the overall construction. As discussed earlier, the insulating material can be added at the manufacturing facility, or may be poured into the space between the outer shell and the inner tank at the installation site. However, it has been recognized that adding of the insulating material at the installation site can pose quality control problems, due to the various sources or contractors which must be relied upon at various installation sites. Utilizing a lightweight air-entrapped, or other lightweight insulating material construction, the overall weight for a 2,000-gallon-capacity tank is approximately 10,000 pounds, as compared with 30,000 pounds for previous constructions using standard concrete. Thus, the insulating material can be added at the manufacturing facility, or at least at a reliable source, without being unduly burdensome to ship the container after construction is complete.

Further, utilizing an outer metal shell in combination with a lightweight insulating material, the inner tank can be formed of a nonmetallic material, or having a nonmetallic component, such as fiberglass, while nevertheless satisfying ballistic and impact tests. By way of example, a 250-gallon capacity tank of the present invention was simply dented when rammed with a truck, without causing failure of the internal fiberglass tank. Moreover, it has been recognized that the outer metal shell will shave off the outer casing of a bullet, such that the use of a fiberglass or nonmetallic inner tank is fully acceptable from a ballistic standpoint.

The inner fiberglass tank is constructed in accordance with Underwriters Laboratory No. 1316 and ASTM D4021-86, and is pressure tested before installation in the outer tank. Each of the inner tank walls 80 and 82 preferably is one quarter inch thick fiberglass reinforced plastic.

In another embodiment of the invention, the inner tank 72 is a single-walled fiberglass reinforced plastic tank having outer support ribs and being secured by tie-down straps within the outer steel shell, in the manner already described.

The outer shell 70 is supported on steel saddles 120 which are filled with lightweight concrete to protect the integrity of the steel saddle structure in case of fire. The saddle holds the tank off the ground to permit visual inspection under the tank and may be bolted to a concrete pad, for example, to meet seismic and/or flood requirements.

The container 10A may be provided with suitable inlets and ports, as previously discussed. Thus, the container illustrated in FIG. 8 may incorporate a pump suction port 124, an emergency vent port 126, a vent port 128, a manway 130, a gauge port 132, a vapor vent port 134, and a fill port 136. A monitoring port 138 may also be provided.

The steel shell and insulating lightweight concrete provide a strong, heat resistant vault for the inner liquid-containing tank. Tests have shown that the fiberglass remains undamaged in the fire test noted above, that the vault is resistant to puncture, and thus meets ballistics standards, and that the inner tank does not rupture even when the container is severely damaged by external forces such as a truck running into the container. The fiberglass inner tank also offers both internal and external corrosion protection, since the tank will not rust in the presence of condensation. Furthermore, the fiberglass is capable of storing corrosive materials and chemicals that normally cannot be stored in a steel inner tank.

Figure 10:
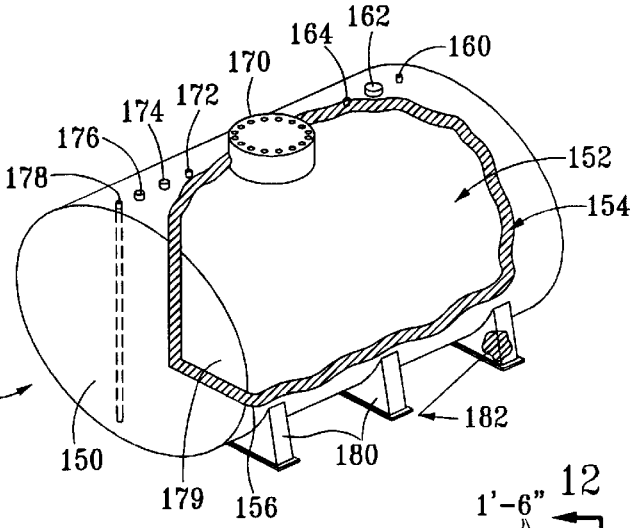
FIG. 10 is a perspective view, in partial section, of a third embodiment of the invention, illustrating a container having a fiberglass jacket steel inner tank.
Figure 11:
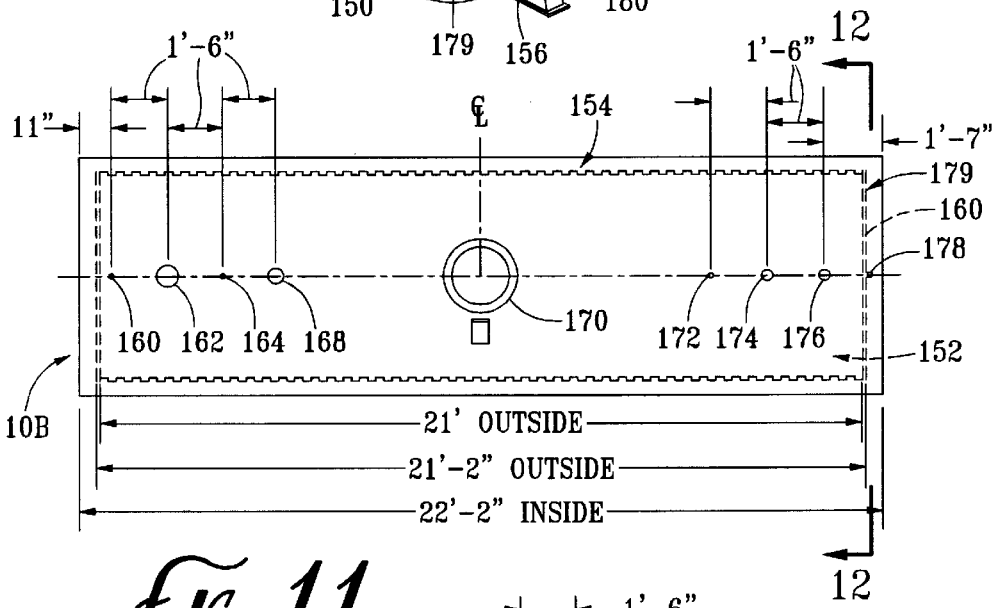
FIG. 11 is a top plan view of the container of FIG. 10.
Figure 12:
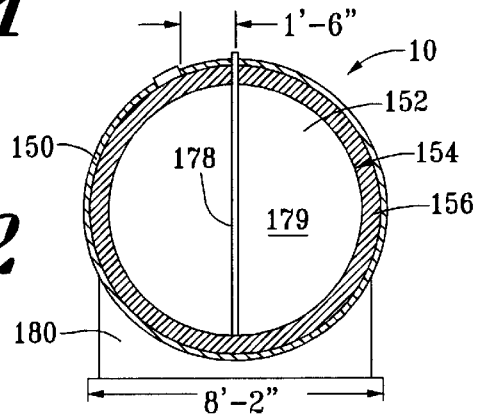
FIG. 12 is a cross-section of the container of FIGS. 10 and 11, taken along line 12—12 of FIG. 11.

Another embodiment of the invention is illustrated in FIGS. 10, 11, and 12 wherein a container 10B incorporates an outer cylindrical steel shell 150 similar to the shell 70 of FIG. 8. Located within the shell 150 is a fiberglass-coated steel inner tank 152 concentrically mounted within the shell 150 and spaced therefrom by a space 154 into which is poured an insulating lightweight concrete 156, as previously discussed.

The inner tank is an Underwriters Laboratories standard 1746/UL58 steel tank coated with UL1316 fiberglass. The fiberglass provides a secondary containment for the inner steel tank, and also protects the outer surface of the inner tank from the corrosive effects of the concrete. The outer surface of the steel inner tank 152 is coated with a primary resin coating which is covered by a resin and chopped fiberglass layer, on which a final resin coating is placed. This laminated surface protects the inner steel tank, as noted above, and provides additional strength. The fiberglass layer is illustrated in phantom in FIG. 11 at 160. The fiberglass coating for the inner tank can also be provided in a jacketed form, with the fiberglass jacket including spaced inner and outer walls disposed about the steel (or other metal) inner tank. Further, the space between the fiberglass walls can be vented and/or provided with leak detection devices.

The container 10B incorporates a number of openings and ports in the manner illustrated with respect to containers 10 and 10A, and thus incorporate a pump suction port 160, and emergency vent port 162, a vent port 164, and a secondary vent port 168, a manway 170, a gauge port 172, a vapor vent port 174, and a fill port 176. A monitor tube 178 is also provided, the tube 178 passing along the surface of one end 179 of the inner tank 152, as illustrated in FIG. 12. In FIG. 11, typical dimensions of a six thousand gallon tank are provided.

The container 10B is supported by saddles 180 which preferably are filled with concrete, as illustrated at 182. Preferably, the saddles are of a steel or other metal construction, with concrete disposed therein to provide for additional insulation, as well as additional structural integrity. The combined use of a metal outer casing and insulating material such as concrete or lightweight concrete is particularly advantageous in a cylindrical tank configuration, since when subjected to extreme temperatures, the concrete will prevent rolling of the tank even when subjected to temperatures which will result in melting or weakening of the outer metal construction. Further, the outer metallic shell construction for the feet or saddle of the tank results in a construction which is not diminished by cracking or environmental effects to which concrete alone may be susceptible.

The outer shell 150 and the insulating material 156 provide a protective enclosure, or vault, for the inner fiberglass-coated steel tank 152, the vaulted construction meeting vehicle impact and ballistics protection requirements of the Underwriters Laboratories for above-ground storage tanks for flammable or corrosive liquids. The outer steel shell 150 is constructed of a minimum 3/16" thick A-36 hot rolled steel while the inner tank 152 has a steel wall at least ¼" thick. The lightweight insulating concrete is preferably about six inches thick to provide the required protection against fire, as noted above.

Figure 13:
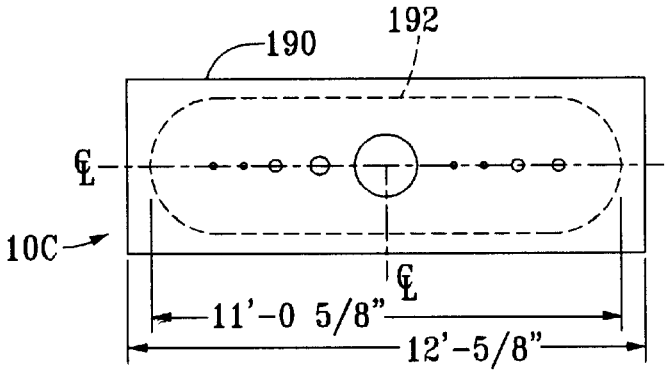
FIG. 13 is a top plan view of a fourth embodiment of the invention, illustrating a container having a polyethylene inner tank.
Figure 14:
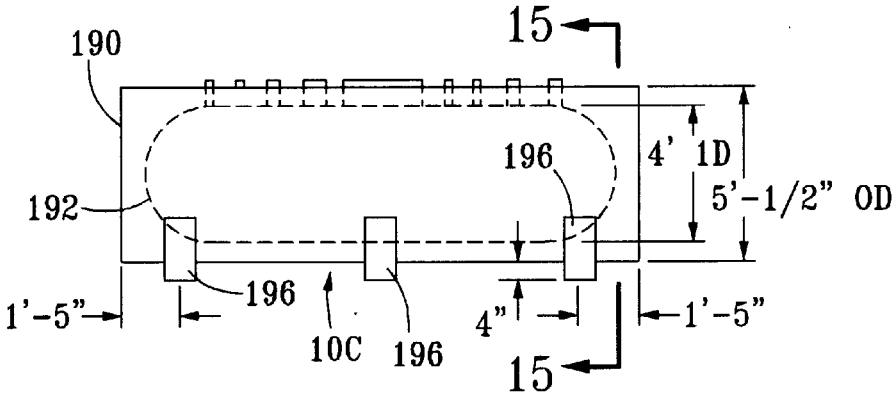
FIG. 14 is a side elevation of the container of FIG. 13.
Figure 15:
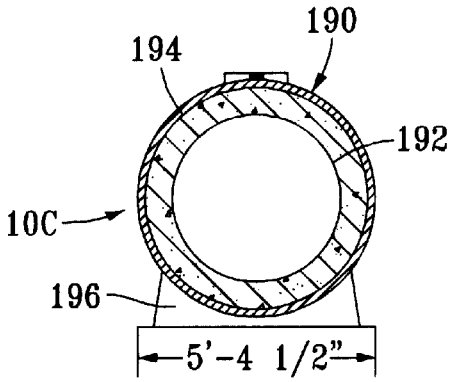
FIG. 15 is a sectional view taken along line 15—15 of FIG. 14.

FIGS. 13, 14, 15 illustrate another embodiment of the container of the present invention, a container 10C having a steel outer cylindrical shell 190 surrounding an inner, concentric and cylindrical polyethylene inner tank 192. The space between the inner tank and the outer shell is filled with a lightweight heat-insulating concrete 194, as discussed above, with the container being supported by saddles 196 also as described above. The walls of the inner tank preferably are about ¼" thick, with the lightweight concrete and the steel outer tank providing structural integrity for the inner tank, also as discussed above. Suitable tie down straps and supports may be provided to hold the inner tank in its desired location while the insulating concrete is poured into place, as previously discussed, but these are not illustrated in FIGS. 13–15 for simplicity of illustration. In addition, the container may include suitable inlet and outlet ports, as discussed above. As shown in FIG. 14, with a non-metallic or fiberglass inner tank, the ends of the tank are rounded for additional strength. By contrast, with a metal inner tank having a fiberglass or other non-metallic coating, the end can be flat as shown in FIG. 11.

The above-ground storage container of the present invention, as described above in its various embodiments, overcomes the inherent problems of exterior concrete tank designs by providing a protective exterior steel tank vault. This construction eliminates the environmental wear on exposed concrete that was conventional in prior concrete-covered storage tanks, and enhances overall insulating capabilities. The lightweight insulating concrete provides the required fire resistance, and the use of the fiberglass, fiberglass coated steel, and polyethylene inner tanks provides corrosion resistance in addition to the foregoing advantages.

Although the invention has been described herein, with reference to preferred embodiments, it is understood that modifications and variations are possible in view of the above teachings. It is therefore to be understood that the invention may be practiced other than as specifically described herein.

What is claimed is:

1. A container for above-ground storage of a hazardous liquid comprising:

an inner closed fiberglass tank for containing said liquid;

an outer steel shell surrounding and spaced from said inner tank and forming a space between the inner tank and the outer shell, the outer steel shell housing and protecting said inner tank; and a heat-resistant insulating material filling the space between said inner tank and said outer shell.

2. A container according to claim 1, wherein:

said inner tank is cylindrical in shape.

3. A container according to claim 2, further including means for preventing said inner tank from floating within said outer shell as said insulating material is added therebetween.

4. A container according to claim 1, wherein the space between the inner tank and outer shell is at least 6 inches wide.

5. A container according to claim 1, further including support feet connected to said outer steel shell for supporting said container spaced from a ground surface upon which said tank is disposed.

6. A container for above-ground storage of a hazardous liquid comprising:

an inner closed fiberglass tank for containing said liquid;

an outer steel shell surrounding and spaced from said inner tank and forming a space between the inner tank and the outer shell, the outer steel shell housing and protecting said inner tank;

support feet connected to said outer steel shell for supporting said container spaced from a ground surface upon which said tank is disposed, said support feet having an outer metallic casing with a non-metallic material disposed inside of said metallic casing; and a lightweight heat-resistant insulating material filling the space between said inner tank and said outer shell.

7. A container according to claim 6, wherein said non-metallic material disposed inside of said metallic casing includes concrete.

8. A container according to claim 7, wherein said non-metallic material is lightweight concrete.

9. A container according to claim 8, wherein said lightweight concrete is an air-entrapped concrete.

10. A container according to claim 1, wherein said heat-resistant insulating material filling the space between the inner tank and outer shell is a concrete.

11. A container according to claim 6, wherein said lightweight heat resistant insulating material is a fire-retardant foam.

12. A container for above-ground storage of flammable liquids, comprising:

an inner tank made of a fiberglass-reinforced material;

an outer steel shell surrounding and spaced from said inner tank to form a space between the outer steel shell and the inner tank, the inner tank having a shape chosen from a group consisting of cubic, cylindrical and rectangular block shapes and the outer shell having a shape chosen from a group consisting of cubic and rectangular block shapes; and a heat-insulating material disposed between said inner tank and said outer shell at least initially in a pourable form that flows between said inner tank and outer shell to fill the entire volume between said inner tank and said outer shell.

13. A container according to claim 12, wherein said inner tank is made of fiberglass-reinforced steel.

14. A container for above-ground storage of flammable liquids, comprising:

an inner tank;

an outer steel shell surrounding and spaced from said inner tank to form a space between the outer steel shell and the inner tank, the inner tank having a shape chosen from a group consisting of cubic, cylindrical and rectangular block shapes and the outer shell having a shape chosen from a group consisting of cubic, cylindrical and rectangular block shapes;

support feet disposed outside of and supporting said outer shell, said support feet including a metallic outer casing and a non-metallic material dispose inside of said non-metallic outer casing; and a lightweight heat-insulating material disposed between said inner tank and said outer shell at least initially in a pourable form that flows between said inner tank and outer shell to fill the entire volume between said inner tank and said outer shell, and wherein said inner tank is constructed of a material chosen from a group consisting of steel, corrosion-resistant steel, and polyethylene.

15. A container according to claim 14, wherein said non-metallic material disposed inside of the outer casing of said support feet includes concrete.

16. A container according to claim 15, wherein said concrete disposed inside of the outer casing of said support feet is a lightweight concrete.

17. A container for above-ground storage of liquids comprising:

an inner tank which includes a fiberglass material;

an outer shell surrounding and spaced from said inner tank to form a space between the outer shell and the inner tank, said outer shell including a metal outer shell; and a heat-insulating material disposed between said inner tank and outer shell and substantially filling the space between the outer shell and the inner tank.

18. A container according to claim 17, wherein said inner tank includes inner surfaces which contact a liquid disposed in said container, said inner tank further including outer surfaces which contact said heat-insulating material, and wherein both of said inner and outer surfaces of said inner tank are non-metallic.

19. A container according to claim 14, wherein said inner tank includes a metal shell and a non-metallic coating.

20. A container according to claim 17, wherein said inner tank is a fiberglass tank and the heat-insulating material includes concrete.

21. A container according to claim 14, wherein said inner tank has a substantially cylindrical configuration with rounded ends and the heat-insulating material is lightweight concrete.

22. A container according to claim 14, wherein said inner tank includes a metallic shell with a non-metallic coating, said inner tank having a substantially cylindrical construction and having flat ends.

23. A container according to claim 14, wherein said container further includes anchor means for preventing said inner tank from contacting an upper surface of said outer shell during introduction of said lightweight heat-insulating material.

24. A container according to claim 23, wherein said anchor means include at least one strap connected to said inner tank.

25. A container according to claim 23, wherein said anchor means include a plurality of straps, each extending between said inner tank and said outer shell.

26. A container according to claim 23, further including at least one spacer disposed beneath said inner tank and between said inner tank and outer shell.

27. A container according to claim 26, wherein said at least one spacer is formed of a heat-insulating material.

28. A container according to claim 27, wherein said spacer is formed of the same lightweight heat-insulating material as said lightweight heat-insulating material disposed between said inner tank and outer shell, and wherein said spacer is provided between said inner tank and outer shell in solid form prior to introducing said lightweight heat-insulating material into said space in said pourable form.

29. A container for above-ground storage of liquids comprising:

an inner tank which includes a non-metallic material;

an outer shell surrounding and spaced from said inner tank to form a space between the outer shell and the inner tank, said outer shell including a metal outer shell;

support feet connected to said outer shell for supporting said outer shell spaced from a ground surface, said support feet including an outer metallic casing and a non-metallic material disposed inside of said support feet; and a lightweight heat-insulating material disposed between said inner tank and outer shell.

30. A container according to claim 17, wherein said inner tank has a double-walled construction.

31. A container according to claim 14, wherein said inner tank includes a metal shell with a non-metallic jacket there around, said non-metallic jacket including inner and outer non-metallic surfaces spaced from the metal shell.

32. A container according to claim 31, wherein said non-metallic jacket is fiberglass.

33. A container for above-ground storage of liquids comprising:

an inner tank;

a metallic outer shell surrounding and spaced apart from said inner tank to form a space between the inner tank and the outer shell;

a heat insulating material disposed between said inner tank and outer shell, said heat insulating material including cement, being initially provided in a pourable form and being introduced into the space between said tank and said outer shell in the pourable form;

means for preventing said inner tank from contacting said outer shell during introduction of said heat insulating material; and a plurality of supports extending from said metallic outer shell and supporting the container above the ground, said supports including a metallic outer casing having a non-metallic material disposed therein.

34. A container for above-ground storage of liquids comprising:

an inner tank;

a metallic outer shell surrounding and spaced apart from said inner tank to form a space between the inner tank and the outer shell;

a heat insulating material disposed between said inner tank and outer shell, said heat insulating material being initially provided in a pourable form and being introduced into the space between said tank and said outer shell in the pourable form;

means for preventing said inner tank from contacting said outer shell during introduction of said heat insulating material; and a plurality of supports extending from said metallic outer shell and supporting the container above the ground, said supports including a metallic outer casing having a non-metalilc material disposed therein, said non-metallic material in the outer casing of the supports being lightweight weight concrete.

35. A container according to claim 33, wherein the means for preventing said inner tank from contacting said outer shell includes a plurality of straps extending between the inner tank and the outer shell.

* * * * *